US009682416B2

(12) United States Patent
Jarrier

(10) Patent No.: US 9,682,416 B2
(45) Date of Patent: Jun. 20, 2017

(54) MECHANICAL CONTACT DEVICE, SUCH AS A BACK STOP FOR A PRESS BRAKE

(71) Applicant: AMADA EUROPE, Tremblay-en-France (FR)

(72) Inventor: Kévin Jarrier, Teloche (FR)

(73) Assignee: AMADA EUROPE, Tremblay-en-France (FR)

( * ) Notice: Subject to any disclaimer, the term of this patent is extended or adjusted under 35 U.S.C. 154(b) by 0 days.

(21) Appl. No.: 15/255,228

(22) Filed: Sep. 2, 2016

(65) Prior Publication Data

US 2017/0066032 A1 Mar. 9, 2017

(30) Foreign Application Priority Data

Sep. 8, 2015 (FR) ..... 15 58325

(51) Int. Cl.

| | |
|---|---|
| ***B21D 11/22*** | (2006.01) |
| ***B21D 43/26*** | (2006.01) |
| ***B21D 5/02*** | (2006.01) |
| ***B21D 5/00*** | (2006.01) |

(52) U.S. Cl.

CPC ..... *B21D 43/26* (2013.01); *B21D 5/002* (2013.01); *B21D 5/0281* (2013.01)

(58) Field of Classification Search

CPC ..... B21D 43/26; B21D 5/0281; B21D 5/002
USPC ..... 72/389.1
See application file for complete search history.

(56) References Cited

U.S. PATENT DOCUMENTS

| | | | | |
|---|---|---|---|---|
| 4,055,070 A * | 10/1977 | Wingate | ..... | B21D 5/002 72/461 |
| 4,411,150 A * | 10/1983 | Klein | ..... | B21D 43/26 72/389.3 |
| 5,526,672 A * | 6/1996 | Cain | ..... | B21D 5/002 72/389.3 |
| 8,683,835 B2 * | 4/2014 | Austaller | ..... | B21D 5/002 72/31.1 |

FOREIGN PATENT DOCUMENTS

| | | |
|---|---|---|
| EP | 1264647 A1 | 12/2002 |
| JP | 2002292430 A | 10/2002 |

* cited by examiner

*Primary Examiner* — David B Jones
(74) *Attorney, Agent, or Firm* — Bookoff McAndrews, PLLC

(57) ABSTRACT

The device comprises a base (12), a mobile support (14), a contact member (16), a lever (34) which comprises a blocking arm (38) pivotally mounted around an axis (36). The device comprises retention means (40, 42) capable of opposing the pivoting of the lever. The device also comprises a reaction member (48A) fixed with respect to the base (12) and capable of cooperating with a reaction zone of the blocking arm (38) by defining a reaction surface inclined with respect to the translation direction X of the support on the base. The pivoting of the lever allowed by the release of the retention means allows the displacement of the contact member.

16 Claims, 8 Drawing Sheets

MECHANICAL CONTACT DEVICE, SUCH AS A BACK STOP FOR A PRESS BRAKE

The present disclosure relates to a mechanical contact device comprising a base, a mobile support capable of moving on the base in a direction X and a contact member carried by the support.

Generally, the mechanical contact device according to the invention can be any device equipping a machine or an apparatus and intended to have a working position in which it comes into contact with a part of a tool and is driven into rapid displacements, for example during maintenance or adjustment operations of the machine or the apparatus.

Thus, the contact member within the meaning of the present disclosure can for example be a tool-holder, for example for a drilling or machining tool, equipping a machine or a robot, or even a blocking or stress-relief pin for a workpiece which must undergo treatment in a machine. In particular, the contact member can be a back stop-pin of a press brake.

European patent application no. 1 264 647 discloses a press brake for sheet metal equipped with a mechanical contact device formed by a back stop device comprising a contact member formed by a stop-pin.

This press brake comprises a frame having on its front side a vertically mobile upper apron and a lower counter-bending apron. A piece of sheet metal needing to be bent is positioned in the space between the two aprons, the rear edge of this piece of sheet metal coming into abutment against the contact member of the rear stop device to ensure its correct positioning during bending. For bending, the upper apron is displaced downward and the tools that it carries carry out the bending in cooperation with the die held by the lower apron. The operating speeds of press brakes are high and the operations of positioning the piece of sheet metal and of adjusting the positions of the different elements constituting the press brake must be carried out rapidly. During these adjusting operations, a portion of the body of the operator, particularly his hands, may be situated in the space between the upper and lower aprons or in close proximity to one of these aprons, in particular the lower apron. Normally, during an adjusting or repositioning operation, the entire rear stop device is moved back. At the conclusion of such an operation, the assembly is rapidly moved forward so that the contact member moves into its working position, in which it carries out its function of back stop.

In particular, one or more back stop devices of the aforementioned kind are mounted on a main carriage which, upon completion of an adjusting or repositioning operation, moves this device(s) rapidly forward.

It is important to protect the operator from injuries which could occur if, during this rapid forward movement, the contact member were to strike a portion of his body, in particular his hand.

In certain press brakes, the forward movement occurs in two stages, that is a first rapid phase from the extreme rear position until an intermediate position, then a final phase of forward movement which, in the zone in which it risks hitting a portion of the operator's body, occurs slowly. However, this hinders manufacturing rates because overall, the speed of displacement of the contact device is affected thereby.

The same problems are posed in general in a machine or an apparatus equipped with a mechanical contact device, the position of which can be adjusted or modified by rapid displacement. It is in fact important to avoid that such a displacement, when it occurs in particular during an adjustment or maintenance operation of the machine or the apparatus, produces injuries or material damage if it causes an impact between the contact member and a portion of the body of a person or an object improperly positioned on the path of the contact member. It is also important to avoid systematically slowing the speed of such a displacement.

According to a first aspect, a mechanical contact device is proposed making it possible to limit or avoid risks of injuries to a person or material damages if a portion of the body of a person or an object were to be struck by the contact member during an operation or a manoeuvre, such as for example an adjustment or a repositioning of a machine or an apparatus equipped with the contact device, while substantially correcting the aforementioned disadvantages.

Thus, according to the first aspect, the mobile support is pivotally mounted on the base around a mobile support axis oriented in a direction Y substantially perpendicular to the direction X, and the mechanical contact device includes:

- a lever, which has a blocking arm and which is pivotally mounted around a lever axis carried by one of the elements comprising the mobile support and the base, this axis being oriented in a direction Z substantially perpendicular to the direction X and to the direction Y, the lever being capable of occupying a rest position and a pivoted position,
- retention means capable of opposing the pivoting of the lever thus retaining the lever in its rest position and of being deactivated to release the pivoting of the lever toward its pivoted position,
- at least one reaction member, fixed with respect to the other of the elements comprising the mobile support and the base, and capable of cooperating by contact with at least one reaction zone of the blocking arm which is distant from the lever axis by defining a reaction surface which is inclined with respect to the direction X and with respect to the direction Z.

For example, the direction X is a horizontal direction for front-and-rear displacement, the directly Y is the vertical direction and the direction Z is a horizontal direction for left-and-right displacement. This is particularly the case when the contact device is a back stop device for a press brake.

It is understood that, when the retention means are active and thus retain the lever in its rest position, the contact member plays its role of mechanical contact, for example a press brake back stop. In fact, in this case, the displacement of the mobile support under the effect of a (rearward) thrust exerted in the direction X is restrained, so that the contact member can cooperate by static contact with a part, for example the rear edge of a piece of sheet metal needing to be bent. On the other hand, when the retention means are deactivated, if the contact member strikes an object or a portion of the body of a person during a forward displacement of the contact device in the direction X, this impact causes a (rearward) thrust on the contact member, this thrust causing, between the reaction member and the reaction zone, a reaction effort which causes pivoting of the lever about the lever axis, toward the pivoted position. This pivoting releases the rearward thrust of the contact member in the direction X, avoiding damage which could be caused by this impact, or reducing them considerably.

Moreover, if an impact due to a relative displacement, operated in the direction Z, between the contact member and an object or a portion of the body of a person occurs while the retention means are deactivated, such an impact will also cause a reaction force between the reaction member and the reaction zone. Due to the inclination of the reaction surface, this reaction force will also cause the lever to pivot and will release the displacement of the contact member, this time by pivoting around its mobile support axis.

It is noted that the device defined above does not, or practically does not affect the normal movement speed of the contact member and consequently does not or practically does not affect the production rate of the machine, a press brake for example, which is equipped with the mechanical contact device.

Optionally, the device includes two reaction members positioned substantially on either side of a plane of symmetry, and the blocking arm has two reaction zones which, when the lever is in its rest position, are positioned substantially symmetrically on either side of said plane of symmetry, said plane of symmetry being parallel to the directions X and Y and being defined when the lever is in its rest position.

In particular, this arrangement makes it possible to obtain the same effect during an impact due to a relative displacement between the contact member and an object or the body of a person in the direction Z, in one direction or in the other, i.e. when the direction Z is a horizontal left-and-right direction, either to the right or to the left.

Optionally, the retention means are capable of being controlled between a retention configuration in which they are active and oppose pivoting of the lever, and the release configuration in which they are deactivated.

In this case, the retention means are not constantly effective. In particular, the retention means can be controlled into the retention configuration when the machine equipped with the contact device is in operation, for example during bending operations carried out in a press brake, and be controlled into a release configuration during adjustment operations of the machine prior to or consecutive with its operation, in particular of the kind requiring an intervention by an operator. In particular, the retention means can be controlled via an electronic control unit.

Optionally, the reaction surface is at least partly convex. This favors, in the release configuration, sliding between the reaction member and the reaction zone, and thus favors pivoting of the lever.

Optionally, the lever axis is carried by the mobile support and said at least one reaction member is fixed with respect to the base.

Optionally, the retention means comprise a first retention member fixed with respect to the base and a second retention member carried by the lever.

Optionally, one of the first and second retention members comprises an element selected from among a latch, a permanent magnet, an electromagnet and a suction cup, while the other of the first and second retention members comprises a retention surface capable of cooperating with said element.

The retention means can also comprise other means, for example a weight carried by the lever or integral with it to naturally return the lever into its rest position under the effect of gravity. This weight can be directly integrated into the lever, by being for example formed by a secondary arm forming an angle with the blocking arm and having sufficient mass for returning the lever into the rest position. It can also be formed on the blocking arm or on another portion of the lever, provided that it has the tendency to return it to its rest position.

Such a weight can form the second aforementioned retention member. As for the first retention member, if it is present, the base can have a stop surface against which a portion of the lever abuts during its return by the weight under the effect of gravity.

In particular, the retention means can exert constant retention, such as for example when one of the first and second retention members comprises a permanent magnet or a permanent latch which can be unlatched by an effort opposing a constant elastic return into the latched position. In this case, the retention means are naturally active and are deactivated during an impact on the contact member, the intensity of which exceeds the retention effort exerted by said retention means.

However, as indicated, the retention means can be of the type capable of being controlled between the retention configuration and the release configuration. This is the case, for example, when one of the first and second retention members comprises a controlled latch, an electromagnet or a suction cup. In this case, the retention means are activated in the retention configuration, for example during bending operations carried out in a press brake, and can be deactivated in the release configuration, to allow adjustments of the press brake.

According to a second aspect, the lever carries a blocking stop, constantly returned into an inactive position and capable, in the event of a shock on the contact member causing pivoting of the lever when the retention means are active, of adopting an active position in which said pivoting of the lever is limited by a contact between said blocking stop and a counter-stop fixed with respect to the mobile support.

For example, when the machine equipped with the mechanical contract device is a press brake, such a shock can be due to the sudden introduction of a piece of sheet metal needing to be bent in the press brake. If the introduction of the piece of sheet metal causes such a shock on the contact member, when a bending operation is starting, this shock could, if its intensity is very high, release in an untimely manner the displacement of the lever, bypassing the retention effort exerted by the retention means even though they are active, thus ensuring that the contact member also moves and thus leaves its desired operating position. The aforementioned blocking stop allows that to be avoided because, during such a shock on the contact member, the mobile support moves and causes pivoting of the lever to begin. However, the blocking stop, then in its active position, then prevents the lever from pivoting further thanks to contact between this blocking stop and the blocking surface of the mobile support, before the retention carried out by the retention means ceases to be effective. The lever is then stopped in a position that is only slightly pivoted, and this retention, combined with cooperation between the reaction member of the base and the reaction zone of the blocking arm, stops the displacement of the mobile support with respect to the base as long as the retention means remain active. Thus, the contact member does not move further than over the short path which caused the slight pivoting of the lever.

Conventionally, a shock causes an intense effort which ceases immediately. The contact between the blocking stop and the counter-stop occurs before this effort overcomes the retention effort exerted by the active retention means. It is only if a considerable effort is applied continuously, as in the case where an object is struck by the contact member in movement and would form an obstacle to its travel that, depending on its intensity, this effort will be able to overcome the retention force exerted by the active retention means. If this retention force is exceeded, the retention means are then deactivated, which allows the blocking stop to return to its inactive position, so that the pivoting of the lever is released, which allows displacement of the contact member.

Thus, the blocking stop is useful both when the retention means are of the constant type (for example with a weight, a latch or a permanent magnet) or exerting a by-passable retention force and when the retention means are of the type that can be controlled between the retention configuration and the release configuration, and consist for example of a controllable latch, an electromagnet or a suction cup.

Optionally, the device includes a stop actuator capable, in the event of a shock on the contact member, of cooperating with the blocking stop to bias the latter into its active position.

Optionally, the stop actuator is fixed with respect to the second retention member.

Optionally, the stop actuator is capable of cooperating with the blocking stop via at least one ramp which is provided on one of the elements comprising the stop actuator and the blocking stop.

The displacement of the mobile stop under the effect of the shock is thus facilitated and can occur in a direction different from that of the force exerted on it by the stop actuator.

Optionally, the device includes means for returning the lever into the rest position while the blocking stop is in contact with the counter-stop and the retaining means are in the retaining configuration.

As indicated previously, a shock can cause a slight pivoting of the lever, but it remains blocked by contact between the blocking stop and the counter-stop. Since this shock produces an instantaneous effort, the intensity whereof disappears after the shock, the retention means remain in the retention configuration. In this case, the lever is returned to the rest configuration and the slight displacement of the contact member which had occurred during the shock is cancelled.

Optionally, the second retention member is capable of moving with respect to a reaction portion of the lever which is rigidly linked to the blocking arm, the stop actuator being rigidly linked to the second retention member, and one of the elements comprising the stop actuator and the second retention member cooperates with said reaction portion via an elastic return means.

This constitutes a simple and effective means for returning the lever into the rest position while the blocking stop is in contact with the counter-stop and the retention means are in the retention configuration.

Optionally, said reaction portion is formed on a secondary arm of the lever, the second retention member and the actuator are positioned on either side of the secondary arm, and a return spring is interposed between the secondary arm and one of the elements formed by the stop actuator and the second retention member.

The present disclosure also relates to a press brake for sheet metal comprising a mechanical contact device of the type described above, forming a back stop device for the press brake, the press brake further comprising a frame having on the front side an upper, vertically mobile apron, substantially perpendicularly to the directions X and Z, and a lower, counter-bending apron, the base being carried by a main carriage, reciprocally movable in the direction X, preferably via a rail system allowing sliding of the base with respect to the main carriage in the direction Z.

The invention will be well understood and its advantages will appear more clearly upon reading the detailed description that follows, of an embodiment shown by way of a non-limiting example. The description refers to the appended drawings, in which.

Figure 1:
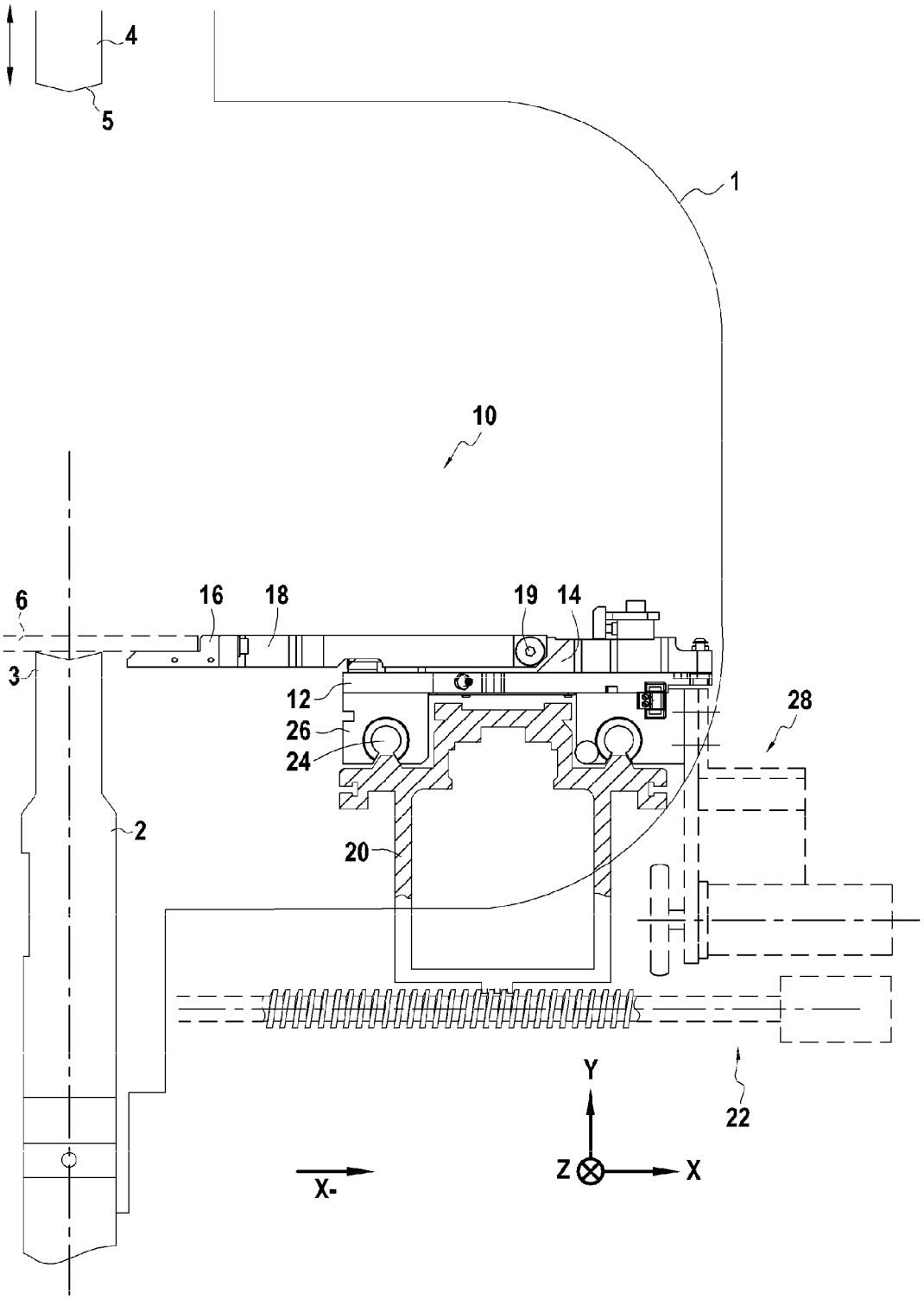
FIG. 1 is a vertical section view in a front-to-rear plane of a press brake comprising a back stop device formed by a mechanical contact device according to the invention.

A side cheek of a frame 1 of a press brake is shown in FIG. 1, the cheek being shaped as a swan-neck and having on the front side a fixed lower apron 2 upper face of which serves as a support for a bending die 3.

The press brake also includes an upper apron 4 vertically reciprocally movable in the direction Y and carrying at its lower end a bending tool 5 cooperating with the die 3 to, when a piece of sheet metal 6 is positioned in the press brake, carry out bending of said sheet metal.

The press brake comprises a back stop device 10 comprising a base 12, a mobile support 14 capable of moving on the base 12 in a front-and-rear horizontal direction X and a contact member 16, carried by the mobile support 14 and forming in this particular case a back stop-pin of the press brake. In this particular case, the contact member is carried by the support via a spacer 18 attached to the mobile support via a pivoting axis 19 extending in a right-to-left horizontal direction Z which, in certain circumstances, allows the spacer and the contact member to rise by pivoting.

In this particular case, the contact member 16 is therefore positioned on the front of the spacer 18. The back stop device also comprises, in this case, a back cleat 17 carried by the support 14 at its rear end.

In this particular case, the base 12 is carried by the main carriage 20 which is reciprocally movable in the direction X, for example via a worm drive system 22. In this particular case, the base 12 is carried by the main carriage 20 through a rail system allowing sliding of the base 12 with respect to the main carriage 20 along the right-left horizontal direction Z, perpendicular to the plane of the figure. In this particular case, the rail system comprises rail-forming tubes 24 carried by the main carriage 20 and sliders 26 carrying the base 12. The drive system of the slider 26 comprises for example a belt drive device 28 shown with a broken line.

Figure 2:
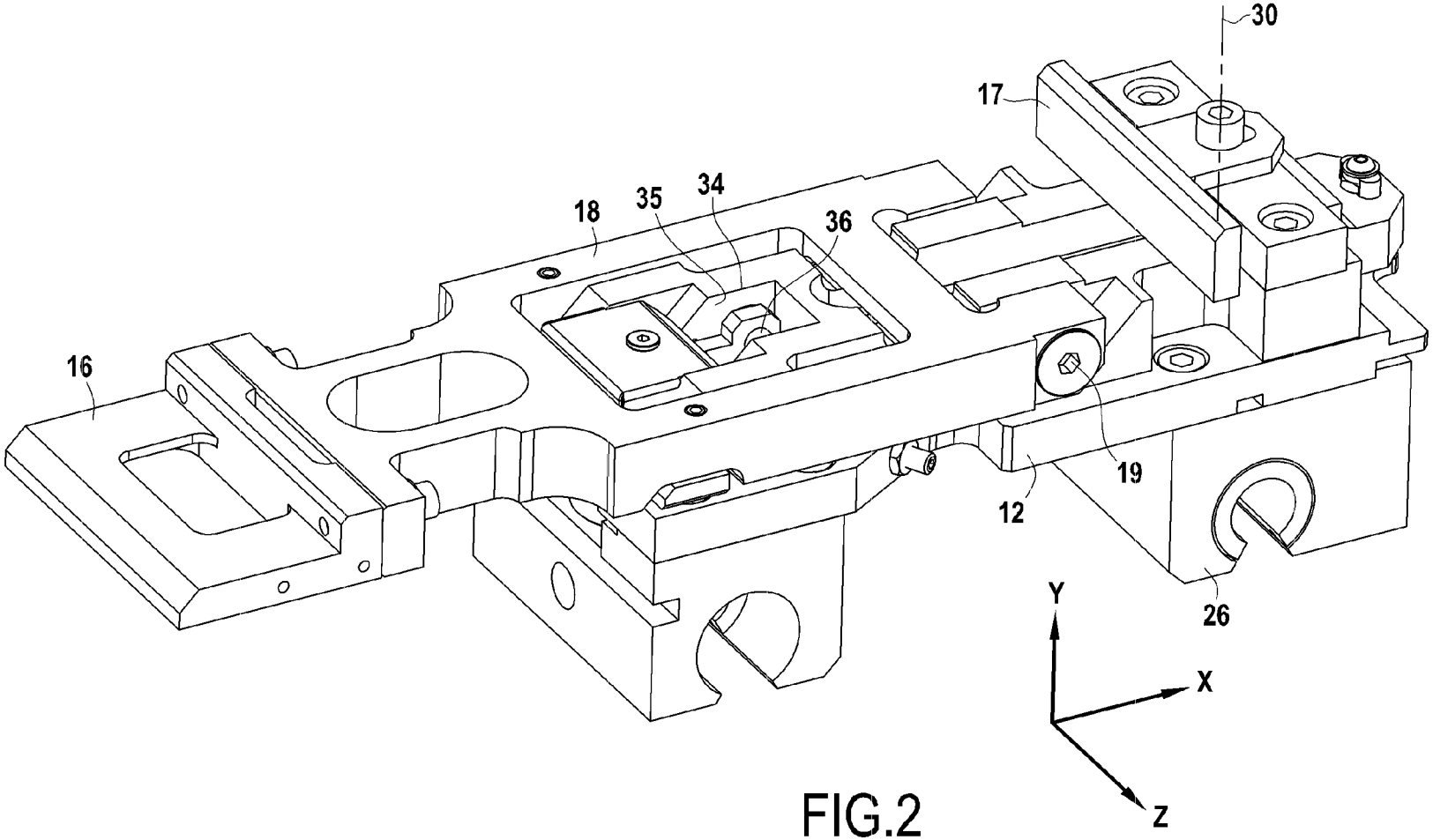
FIG. 2 is a perspective view of the back stop device, with the retention means in the retaining configuration.

In FIG. 2, the back stop device carried by the sliders 26 is shown. The support 14 rests on the base 12 but can slide with respect to it in the direction X. It can also pivot with respect to the base 12 around a mobile support axis 30 oriented in the vertical direction Y. This axis is embodied by a pivot pin 30' (see FIG. 4), which is attached to the base 12 and which passes through an oblong opening 32 in the support 14 so as not to be an obstacle to the sliding of the latter in the direction X with respect to the base.

The device comprises a lever 34 which is pivotally mounted around a lever axis 36 which, in the example shown, is carried by the mobile support 14.

Figure 3:
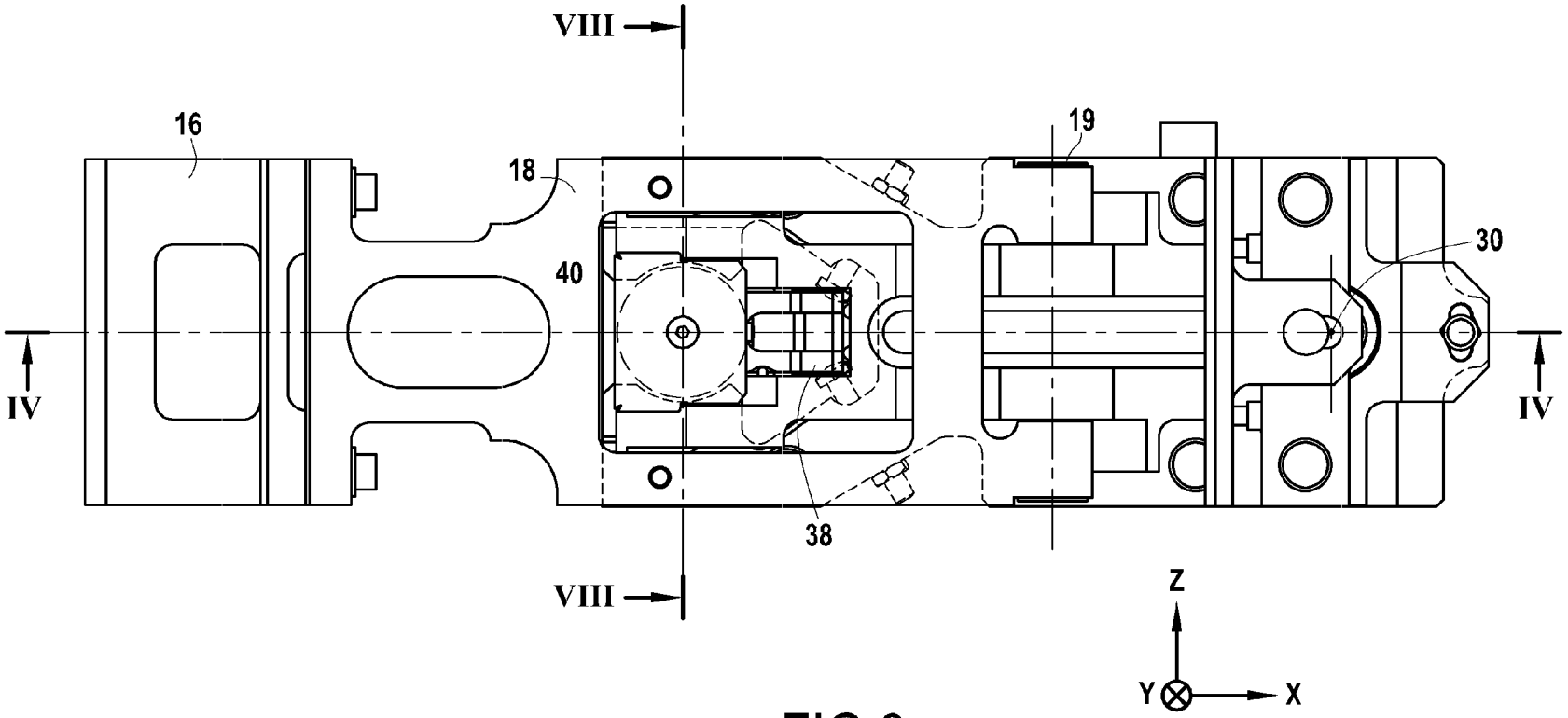
FIG. 3 is a top view of the device of FIG. 2.
Figure 4:
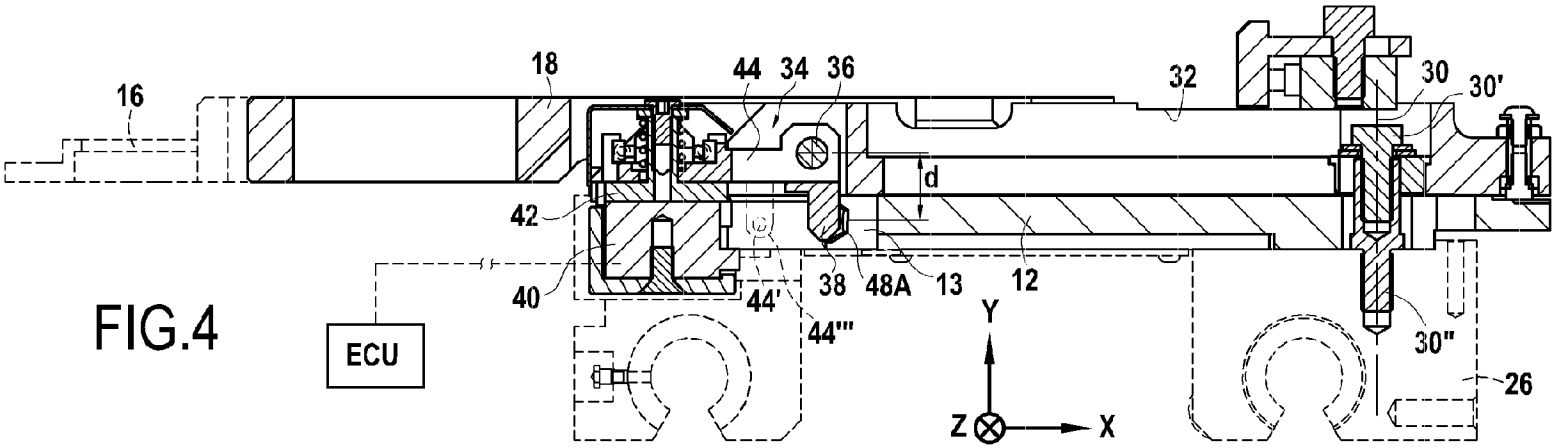
FIG. 4 is a section view in plane IV-IV of FIG. 3.

The conformation of the lever 34 will be better understood by referring to FIGS. 3 and 4. This lever has a blocking arm 38 which is pivotally mounted around the lever axis 36. FIG. 4 shows the lever at rest, while FIG. 5 shows the lever in a position pivoted around the axis 36.

Figure 5:
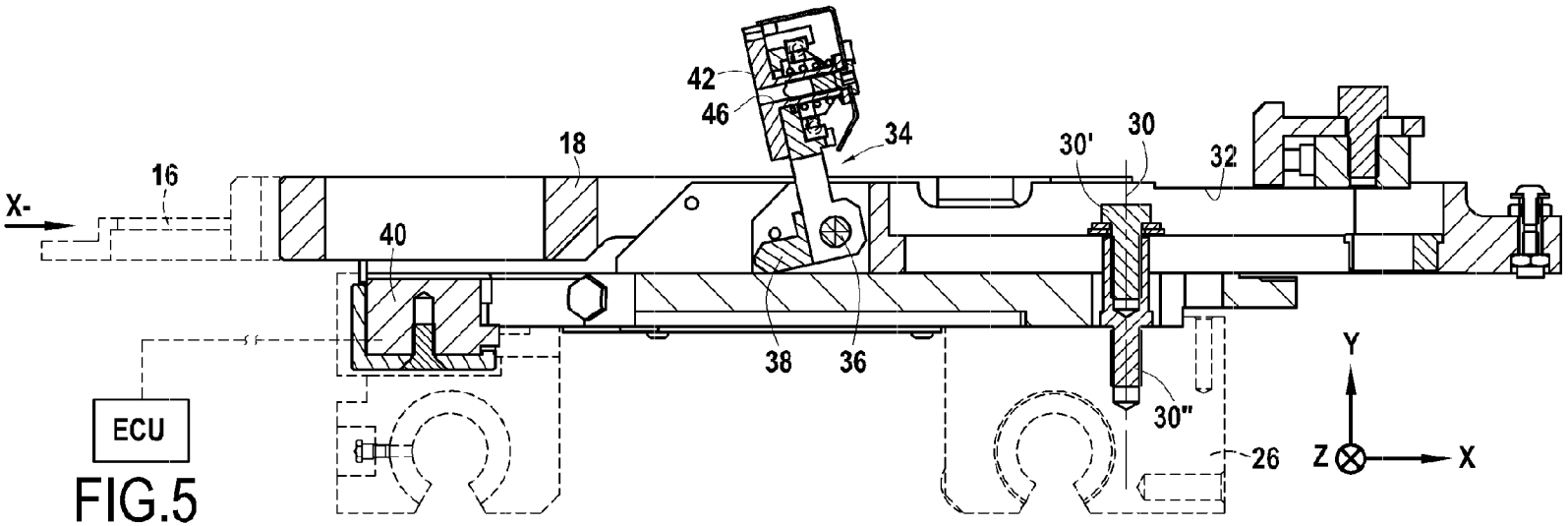
FIG. 5 is a section view in the same plane as FIG. 4, for a configuration in which the retaining means are in the release configuration.

The device comprises retention means which, in FIG. 4, are active in a retaining configuration and oppose the pivoting of the lever, which is thus held in its rest position and which, in FIG. 5, are activated in a release configuration in which the lever can be pivoted.

In this particular case, these retention means comprise a n electromagnet 40 which forms a first retention member fixed with respect to the base 12. The lever comprises a second retention member 42 which, in this particular case, is carried by a secondary arm 44 of the lever positioned in such a manner that, with the blocking arm 38, it forms substantially an L, the blocking arm forming in this case the short leg of the L and being oriented downward. The second retention element 42 has a surface made of a material sensitive to magnetic attraction, to be able to be retained against the electromagnet 40 when the latter is activated.

It is possible to provide for other retention means. For example, the electromagnet could be replaced by a pneumatic suction cup, in which case the surface of the second retention member located facing the suction cup would be a solid surface (the threading 46 visible in FIGS. 4 and 5, which will be described later, need not pass through the part).

The retention means could also comprise a latch, comprising for example, as the second retention member carried by the lever 34, a staple formed by a depression or a bore 44' in an extension 44" of the arm 44 facing a wall of the base 12 and a bolt, carried by the base and capable of extending into this staple and to be retracted into that wall of the base. The edge of the bore would then form the retention surface.

The retention means can be of the type capable of being controlled between the retention configuration and the release configuration, for example by an electronic control unit ECU controlling one of the retention members. In this particular case, FIG. 4 shows such a unit connected electrically to the electromagnet 42. The same could be true of a pneumatic suction cup, or a controllable bolt-type latch.

However, the retention means can be of the constant retention type. For example, the retention means can comprise a weight, a permanent magnet or a constant latch the bolt of which could however retract if a considerable effort is exerted on the lever, for example if the lever is displaced and strikes a part or a portion of the body of a person such as an operator. For example cooperation between the bolt and the staple could occur via a ramp tending to return the bolt into the retracted position during a displacement between the staple and the bolt, countering a constant elastic return of the bolt into the extended position, the stiffness of the elastic return being determined so as to allow retraction of the bolt based only on a given intensity of the efforts against the staple and the bolt.

As indicated, FIG. 4 shows the retention means in the retention configuration, and it can be seen on this figure that the lever 34 is in its rest position, in which the blocking arm 38 faces reaction members (described later) provided in a recess 13 in the base into which the blocking arm extends in this rest position.

On the other hand, in FIG. 5, the lever has pivoted and occupies its raised pivoted position. Therefore, if the impact has been exerted against the contact member 16 in the direction X- (in this case toward the rear) parallel to the direction X, the assembly formed by the mobile support 14 and by the pin 16 has been able to move in the direction X- as can be seen when comparing FIG. 5 to FIG. 4.

Figure 6:
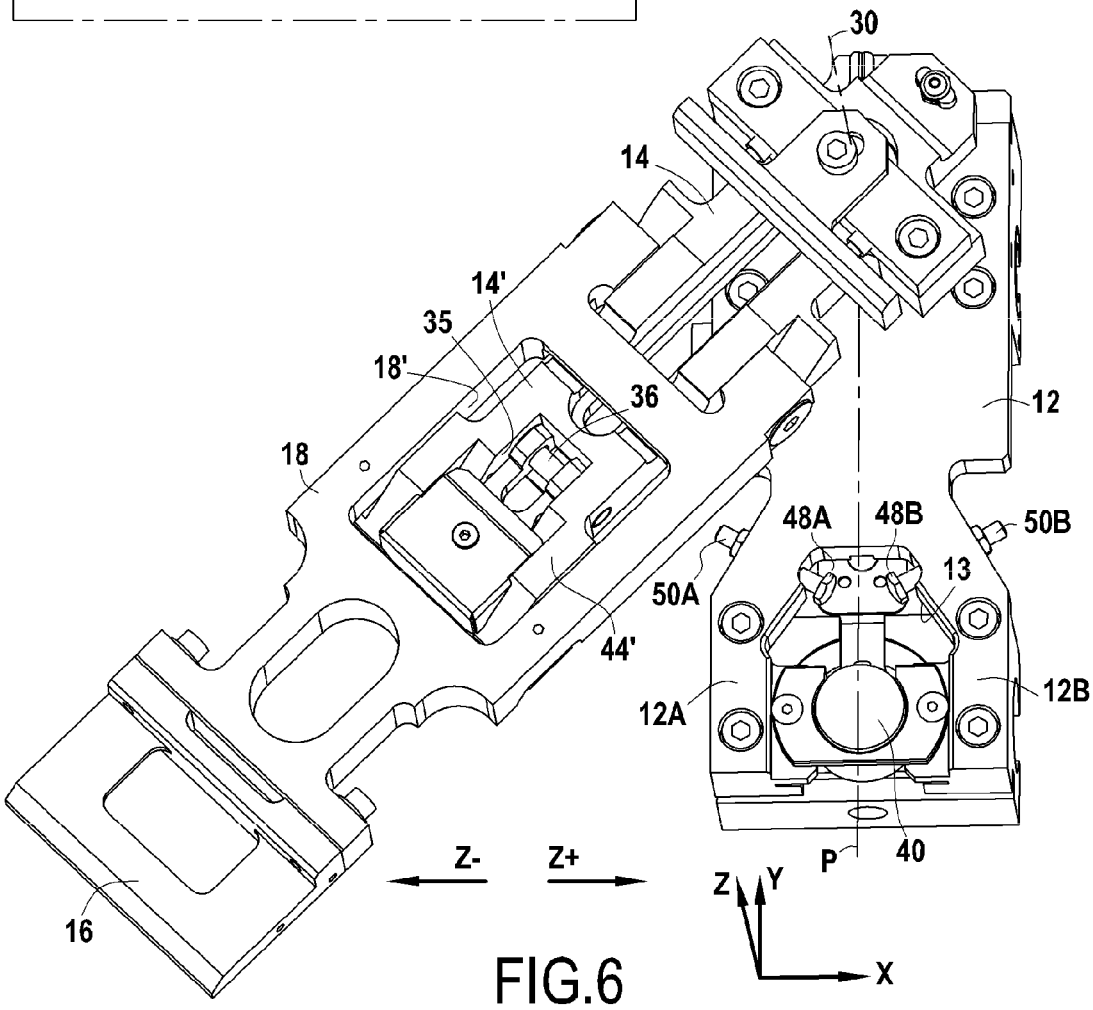
FIG. 6 is a perspective view of the device of FIG. 2, when the mobile support has moved by pivoting around the mobile support axis.

In FIG. 6, the same assembly has moved this time by pivoting around the axis 30 which, as can be seen better in FIGS. 4 and 5, is in this case embodied in a pivot pin 30' mounted in a cavity of a stud 30", itself fixed with respect to the base 12, in this case by being screwed into one of the sliders 26. The head of the pivot pin 30' is retained vertically in a depression in the base 12, by washers cooperating with a shoulder. This pivoting of the lever around the axis 30 was caused by an impact on the contact member 16 in the direction Z– (in this case to the left) parallel to the direction Z. During such an impact, the retention means being in the release configuration, the blocking arm 38 of the lever has cooperated with the reaction members to allow the lever to rise, thus escaping the walls of the recess 13, and thus allowing the support 14 and the contact member 16 (and also the spacer 18) to move by pivoting around the axis 30. In FIG. 6, the lever has returned to a position in which its secondary arm 44 is lowered. This return occurs by gravity, under the effect of the weight of the arm 44, the lever being housed in a through window 35 of the support 14.

More precisely, the space 18 has a window 18' in which, when the spacer and the contact member are in the normal lowered position as in particular in FIGS. 2 and 6, an extension 14' of the support protrudes. This, as well as several cut-outs made in particular in the spacer, make it possible to limit its mass, which is useful in the case where lightness is sought, for example to limit the inertia during very rapid movements. For its part, the aforementioned extension 14' forms a fork and thus shows the window 35 between the two arms of this fork, the pivoting axis 36 of the lever being embodied by a pivot pin retained in the edges of this window 35. In the rest configuration of the lever, the secondary arm 44 of the latter is horizontal and located within the window 35, while the blocking arm 38 passes through this window to be located in the recess 13 of the base 12. In fact, as can be seen in FIGS. 4 and 5, the window 35 is in vertical correspondence with the recess 13 in the working position of the contact member 16.

Figure 7:
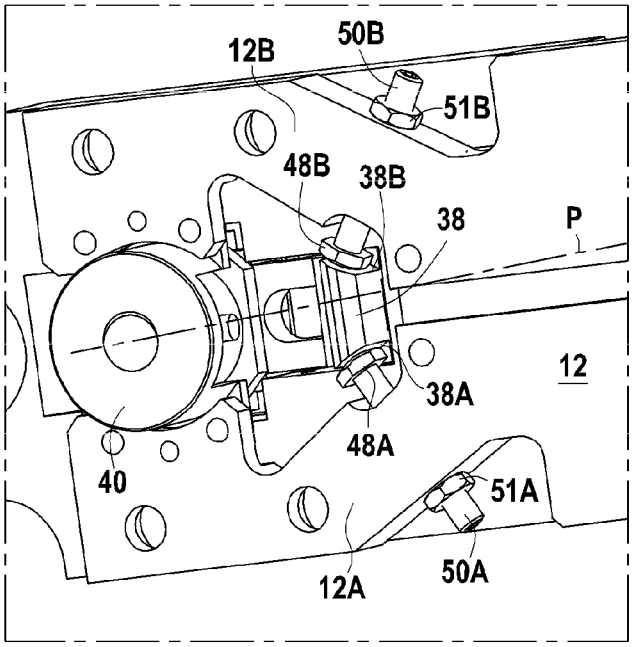
FIG. 7 is a partial view from below, showing the conformation of the reaction member and the reaction zone.

With reference in particular to FIGS. 6 and 7, the conformation of the reaction member is now described which, in the example shown, is fixed with respect to the base 12 and the reaction zone of the blocking arm.

In this particular case, the blocking arm 38 has two reaction zones, respectively 38A and 38B which, when the lever is in its rest position and the contact member is in its working position, are positioned substantially symmetrically on either side of a plane of symmetry P defined by the horizontal direction X and the vertical direction Y. Likewise, the base 12 carries two reaction members, respectively 48A and 48B, to cooperate respectively with each of the two reaction zones. These reaction members are positioned substantially symmetrically with respect to the plane P. In this particular case, these reaction members are formed by screw heads, respectively 50A and 50B, screwed into legs, respectively 12A and 12B, of the base 12 which delimit between them the recess 13 previously defined. These screws, which can be retained by nuts 51A and 51B, can also be adjusted in position so as to be able to precisely adjust the position of the reaction members.

It is seen, in particular in FIGS. 6 and 7, that the outer stop surfaces of the screw heads 48A and 48B, which define the reaction surfaces by being in contact with the reaction zones 38A and 38B, are inclined with respect to the plane P, i.e. in particular inclined both with respect to the direction X and with respect to the direction Z. Thus, these reaction surfaces are located at a distance d (see FIG. 4) from the pivoting axis 36 of the lever. The result is that, when the retention means are deactivated, thrust by the blocking arm on the reaction members will cause pivoting of the lever around its axis 36. In this particular case, the distance d being measured vertically downward from the axis 36, the aforementioned pivoting will occur upward. The distance d can for example be of the order of 5 mm to 30 mm, in particular of the order of 15 mm to 20 mm. This distance can be small and it is sufficient that it allows the desired lever arm for causing pivoting of the lever from a given amplitude for the reaction force between the reaction member(s) and the reaction zone(s).

Due to the inclination of the reaction surface with respect to the direction X, thrust on the contact member 16 in the direction X- will cause pivoting of the lever as can be seen in FIG. 5.

Likewise, due to the inclination of the reaction surfaces with respect to the direction Z, thrust is exerted on the contact member in the direction Z− parallel to the direction Z will cause pivoting of the lever, thus allowing the blocking arm 38 to escape the legs 12A and 12B of the base 12 between which is arranged the recess 13 and consequently allowing the support 14 to pivot around the axis 30 in the direction Z−, due to the fact of the thrust reaction between the reaction zone 38A and the reaction member 48A. Conversely, thrust on the contact member 16 in the direction Z+, parallel to the direction Z but opposite to the direction Z−, will this time cause a reaction between the reaction zone 38B and the reaction member 48B and will therefore cause pivoting of the lever, thus allowing the blocking arm to escape the aforementioned legs 12A and 12B and consequently allowing the support 14 to pivot with respect to the axis 30 in the direction Z+.

Moreover, as can be seen in the perspective view of FIG. 6, the reaction surfaces formed on the reaction members 48A and 48B are slightly convex which, in the release configuration, favors sliding between the reaction members and the reaction zones of the blocking arm, and thus favors pivoting of the lever.

In the appended figures is shown the case where the lever 34 is carried by the support 14, i.e. its axis 36 is carried by the support, while the reaction members 48A and 48B are carried by the base. The configuration could of course be the reverse, in which case the axis of the lever would be carried by the base, while the reaction member(s) would be carried by the support 14.

Figure 13:
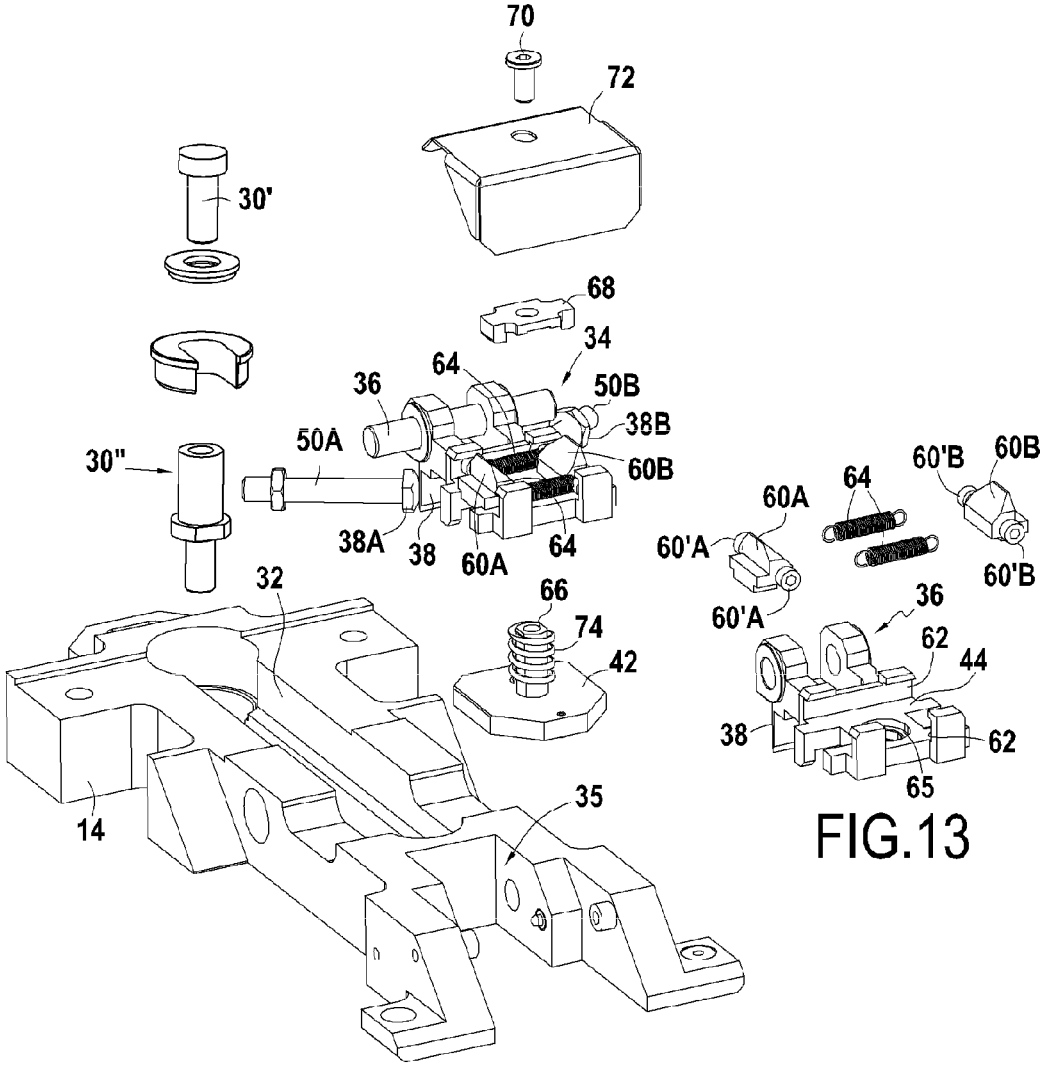
FIG. 13 is an exploded perspective view of some of the elements constituting the lever.

In the example shown, the mechanical contact device includes means for avoiding untimely displacement of the contact member during a shock occurring when the contact member is in the working position and intended to be functional to implement a back stop for a piece of sheet metal which is to be bent in the press brake. These means are more visible in particular in FIGS. 8 to 13. To this end, the lever carries a blocking stop which is constantly returned into an inactive position and which is capable, during such a shock, to adopt an active position limiting the displacement of the lever by a contact between this blocking stop and a stop surface fixed with respect to the mobile support 14. In this particular case, the lever carries two blocking stops, respectively 60A and 60B, which are positioned symmetrically on either side of the plane P (considered when the lever is in its rest position and the contact member is in its working position). In this particular case, these blocking stops are carried by the secondary arm 44 of the lever. In fact, as can be seen better in FIG. 13, this arm 44 has on two opposite edges (in this particular case respectively its front edge and its rear edge) sliding rails 62 formed as recessed in the protruding edges on the upper face of the arm 44. The stops 60A and 60B are formed by parts mounted sliding on these rails and are constantly returned toward one another by return springs 64. These return springs cooperate in this particular case with nipples, respectively 60'A and 60'B, carried by the stops 60A and 60B, respectively protruding on their front and rear sides. These nipples, which can simply be heads of screws screwed into the body of the stops, also form sliders which slide in the aforementioned rails 62.

Moreover, the arm 44 has a central bore 54'. In this particular case, the second retention member 42 is not directly formed by the lower face of the arm 44, but rather it is formed in a plate applied to this arm. In the central region, this plate has a tubular extension 66 which passes through the bore 65 in the arm 44. A faceplate 68 having a vertical section shaped substantially like a U, the legs whereof are positioned downward, is retained with respect to the second retention member 42 using a screw 70 of which the shank is screwed into the threading 46 of the tubular extension 66. In this particular case, a protective cover 72 is interposed between the screw and the faceplate 68. A coil spring 74 is positioned around the tubular extension 66 and is supported, on the one hand, on the upper face of the arm 44 and, on the other hand, on the lower face of the faceplate 68. This spring therefore tends to constantly separate the faceplate from the upper face of the arm 44 and, therefore, to bring the arm 44 closer to the second retention member 42. The faceplate 68 plays the role of a stop actuator which, during a shock on the contact member, cooperates with the stops 60A and 60B to bias them into their active stop position. Thus, the arm 44 plays the role of a reaction portion which is rigidly linked to the blocking arm 38 and with respect to which the second retention member 42 can be moved. For its part, the faceplate plays the role of a stop actuator which is rigidly linked to the second retention member 42 and which cooperates with the reaction portion (arm 44) via the spring 74.

Figure 8:
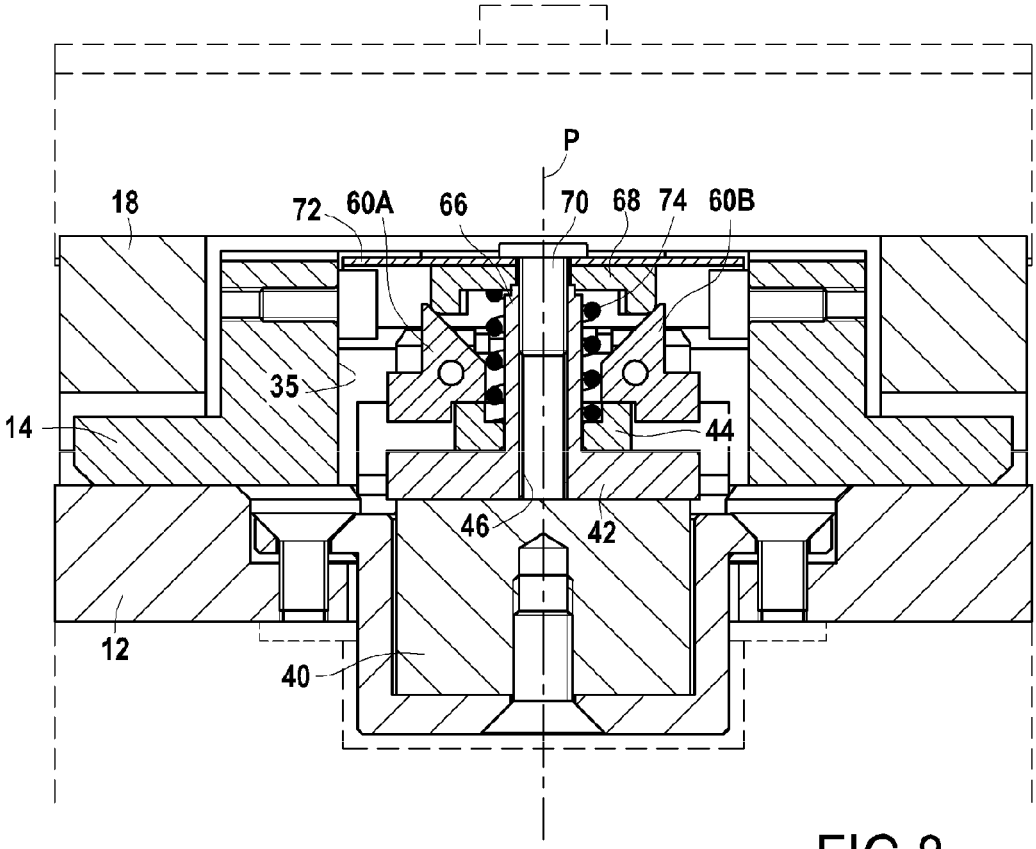
FIG. 8 is a section view in the plane VIII-VIII of FIG. 3, the retention means then being in a retention configuration.
Figure 9:
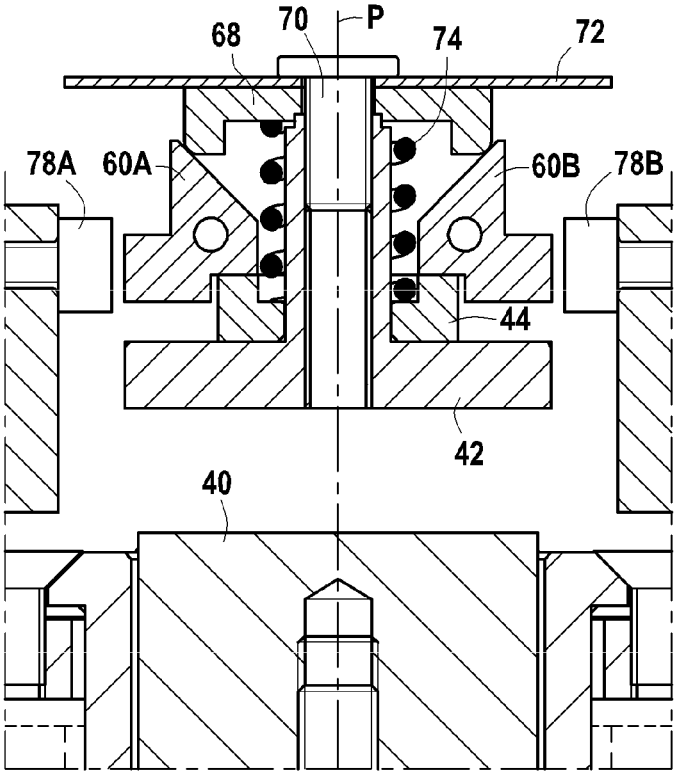
FIG. 9 is a section view in the same plane as FIG. 8, when the retention means are in the release configuration.
Figure 10:
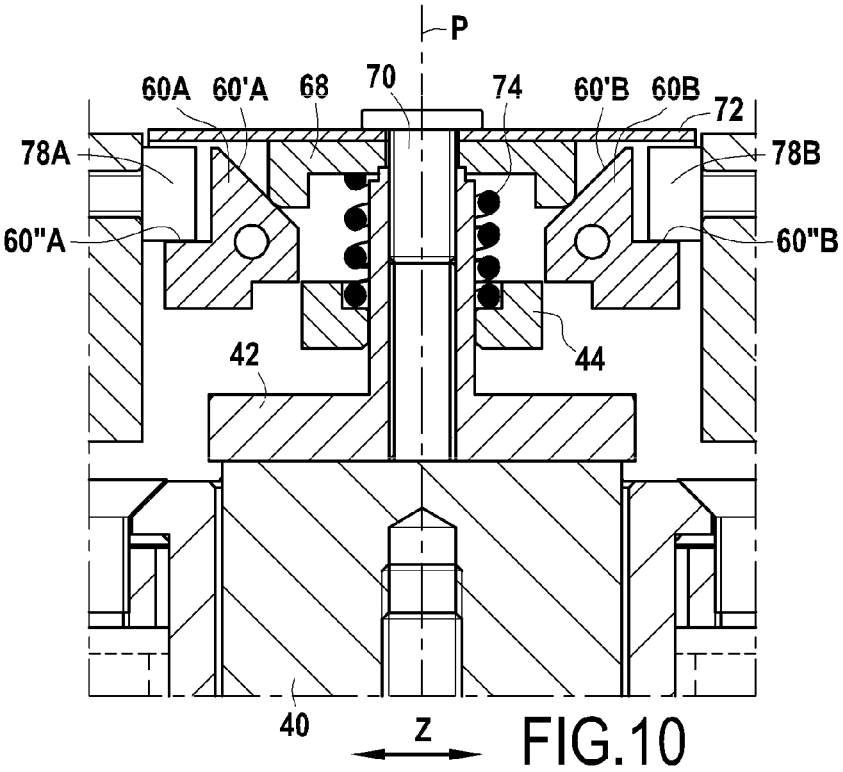
FIG. 10 is a section view in the same plane as FIGS. 8 and 9, when the retention means are in the retention configuration but the blocking stop is activated under the effect of a shock to restrain the pivoting of the lever.

This will be better understood by comparing FIGS. 8, 9 and 10. In FIG. 8, the retention means are in their retention configuration, the second retention member (the plate) 42 being pressed against the electromagnet 40. The stops 60A and 60B are returned to their inactive positions by the springs 64 (see FIG. 4) and the arm 44 is normally separated from the faceplate 68 by the spring 74.

FIG. 9 shows the release configuration. In this case, the plate 42 is separated from the electromagnet 40 which has been deactivated, but the springs continue to return one of the blocking stops 60A and 60B toward the other. It can be seen, therefore, that under the effect of a pivoting of the lever occurring due to contact between the reaction members and the aforementioned reaction surfaces, the arm 44 can rise without limiting this pivoting. In this movement, the blocking stops escape counter-stops, respectively 78A and 78B, located on the sides of the recess 35 of the extension 14' of the support 14 in which the lever is located. The lever can therefore pivot without obstacles, which allows a displacement of the contact member avoiding or limiting the damage caused by a contact of this member with an obstacle such as a part or a portion of the body of a person.

On the other hand, when a shock occurs when the retention means are in their retention configuration, the blocking stops come into contact against the counter-stops. This is what FIG. 10 is showing. In this figure, the retention means are in the retention configuration, and it is seen that the plate 42 is pressed against the electromagnet 40. However, a shock, having impacted the contact member 16 and tending to displace the latter in the direction X- and/or in the direction Z, tends to cause pivoting of the lever around its axis 36 and therefore to lift the arm 44. In FIG. 10, it can be seen in fact that the arm 44 has pivoted and moved away from the plate 42. However, in this movement, the arm 44 has driven with it the stops 60A and 60B, which then cooperate with the faceplate 68 via ramps, respectively 60'A and 60'B located on the inclined upper faces of the blockings stops 60A and 60B. The blocking stops then separate from one another in the direction Z as shown in FIG. 10. On their faces opposite to the plane P, the stops have shoulders, respectively 60"A and 60"B which, during upward displacement of the lever, come into contact with the counter-stops 78A and 78B and therefore prevent the continuation of the pivoting of the lever. This is then blocked in its travel.

However, the plate 42, (second retention member) was still retained against the electromagnet 40. For example, the retention effort exerted by the electromagnet is of the order of 240 N or more. Because the plate is rigidly linked to the faceplate 68 and the spring 74 is interposed between the faceplate and the arm 44, this spring then returns the arm toward the plate 42, which returns the lever into its rest position and therefore returns the contact member to its working position. In this particular case, the spring 74 works in compression. The effect obtained could be the same with a spring operating in tension, which would be interposed between the plate 42 and the arm 44.

Figure 11:
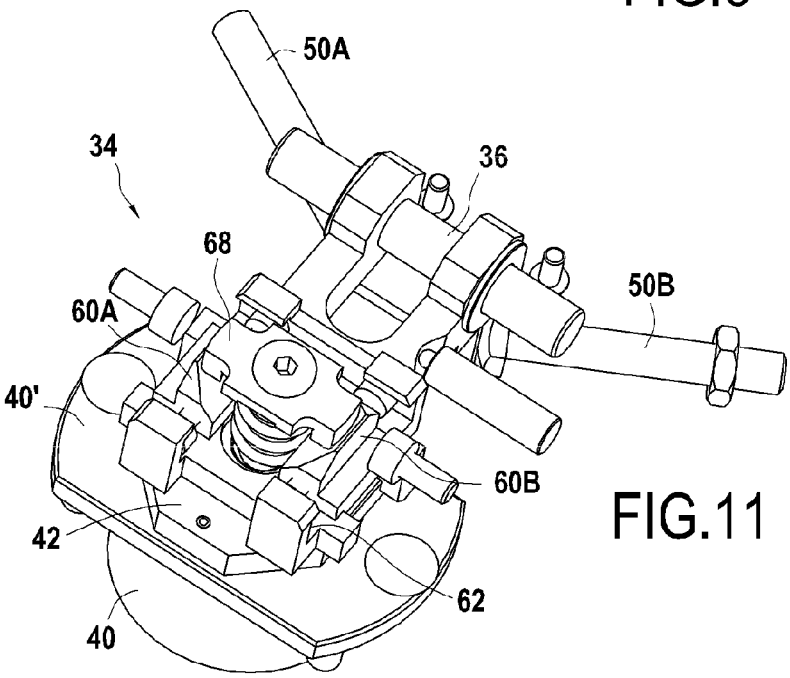
FIG. 11 is a partial perspective view showing principally the lever, the retention means and the reaction members.

In FIG. 11, the entire assembled lever is shown, and also to be seen is the electromagnet 40 which is mounted in a hollow 40' attached to the base 12 by screws 40". Also to be seen is the plate 42 in contact with the electromagnet, the extensions of the arm 44 of the lever in which are implemented the rails 62, the blocking stops 60A and 60B and the faceplate 68. Also embodied in this figure is the pivoting axis 36 of the lever, as well as the screws 50A and 50B, the heads of which form the reaction members.

Figure 12:
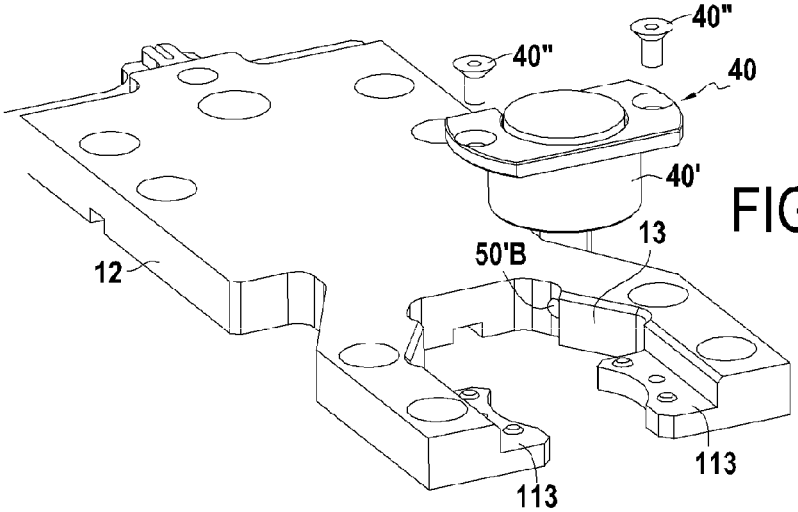
FIG. 12 is an exploded perspective view of some of the elements constituting the back stop device.

The same elements are visible in the exploded perspective of FIG. 12, in which can be better seen the conformation of the base 12, with its recess 13 separating two legs between which is retained the hollow carrying the electromagnet, on edges 113 protruding on the inner faces of the recess. In FIG. 12, the passage 50'B used for installation of the screw 50B the head whereof forms a reaction member, is also visible. Above the base, FIG. 12 shows the mobile support 14, of which the oblong window 32 is particularly seen, above which the pivot pin 30' and the stud 30" are shown, used to form the rotation axis 30 of the support with respect to the base. In FIG. 12 can be seen, to the right of the mobile support 14, the plate 42 with its tubular extension 68 and the spring 74. The remainder of the elements constituting the lever 34 is shown above, the blocking arm 38 is recognizable, the stops 60A and 60B and their springs 64, as well as the pivoting axis 36 of the lever. The faceplate 68 is shown above, but below the cover 72 and the screw 70.

Overall, the base 12, the support 14 and the lever 36 are symmetrical with respect to the plane P (considered when the contact member is in its working position).

The foregoing detailed description refers to a back stop device of a press brake. It must be understood that a press brake can include, and generally includes, several similar back stop devices, spaced from one another along the length of the rails 24. Moreover, as has been indicated, the mechanical contact device according to the invention can be any device, equipping any machine or apparatus, and intended to have a working position in which it comes into contact with a part or a tool and to be driven into rapid movements, for example during maintenance or adjustment operations of the apparatus or the machine.

The invention claimed is:

1. A mechanical contact device comprising a base, a mobile support capable of moving on the base in a direction X and a contact member carried by the mobile support, the mobile support being pivotally mounted on the base around a mobile support axis oriented in a direction Y substantially perpendicular to the direction X; and the mechanical contact device including:

a lever, which has a blocking arm and which is pivotally mounted around a lever axis, carried by one of the elements comprising the mobile support and the base, said lever axis being oriented in a direction Z substantially perpendicular to the direction X and to the direction Y, the lever being capable of occupying a rest position and a pivoted position, a retainer capable of opposing the pivoting of the lever, thus retaining the lever in its rest position and of being deactivated to release the pivoting of the lever toward the pivoted position thereof, at least one reaction member, fixed with respect to the other of the elements comprising the mobile support and the base, and capable of cooperating by contact with at least one reaction zone of the blocking arm which is distant from the lever axis, by defining a reaction surface which is inclined with respect to the direction X and with respect to the direction Z.

2. The device as claimed in claim 1, including two reaction members positioned substantially symmetrically on either side of a plane of symmetry, the blocking arm having two reaction zones positioned substantially symmetrically on either side of said plane of symmetry, said plane of symmetry being parallel to the directions X and Y and being defined when the lever is in its rest position.

3. The device as claimed in claim 1, wherein the retention means are capable of being controlled between a retention configuration in which they are active and oppose pivoting of the lever, and a release configuration in which they are deactivated.

4. The device as claimed in claim 1, wherein the reaction surface is at least partly convex.

5. The device as claimed in claim 1, wherein the lever axis is carried by the mobile support and said at least one reaction member is fixed with respect to the base.

6. The device as claimed in claim 1, wherein the retainer comprises a first retention member fixed with respect to the base and a second retention member carried by the lever.

7. The device as claimed in claim 6, wherein one of the first and second retention members comprises an element selected from among a latch, a permanent magnet, a weight, an electromagnet and a suction cup, while the other of the first and second retention members comprises a retention surface capable of cooperating with said element.

8. The device as claimed in claim 1, wherein the lever carries a blocking stop, constantly returned into an inactive position and capable, during a shock on the contact member causing pivoting of the lever when the retention means are still active, of adopting an active position in which said pivoting of the lever is limited by a contact between said blocking stop and a counter-stop fixed with respect to the mobile support.

9. The device as claimed in claim 8, including a stop actuator capable, during a shock on the contact member, of cooperating with the blocking stop to bias the latter into its active position.

10. The device as claimed in claim 9, wherein the retainer comprises a first retention member fixed with respect to the base and a second retention member carried by the lever, and the stop actuator is fixed with respect to the second retention member.

11. The device as claimed in claim 9, wherein the stop actuator is capable of cooperating with the blocking stop via at least one ramp which is provided on one of the elements comprising the stop actuator and the blocking stop.

12. The device as claimed in claim 8, wherein the lever is returned into its rest position while the blocking stop is in contact with the counter-stop and the retainer is in the retention configuration.

13. The device as claimed in claim 12, wherein the retainer comprises a first retention member fixed with respect to the base and a second retention member carried by the lever, the second retention member being capable of moving with respect to a reaction portion of the lever which is rigidly linked to the blocking arm, the stop actuator is rigidly linked to the second retention member and one of the elements comprising the stop actuator and the second retention member cooperates with said reaction portion via an elastic return.

14. The device as claimed in claim 13, wherein said reaction portion is formed by a secondary arm of the lever, the second retention member and the actuator are positioned on either side of the secondary arm and a return spring is interposed between the secondary arm and one of the elements formed by the stop actuator and the second retention member.

15. A press brake for sheet metal comprising a frame having on the front side an upper apron movable in a vertical direction Y, and a lower, counter-bending apron (2), the press brake comprising a back stop device comprising a base carried by a main carriage, reciprocally movable in a horizontal direction X, a mobile support capable of moving on the base in a first horizontal direction X and a contact member carried by the mobile support, the mobile support being pivotally mounted on the base around a mobile support axis oriented in second horizontal direction Y substantially perpendicular to the direction X; and the back stop device including:

a lever, which has a blocking arm and which is pivotally mounted around a lever axis, carried by one of the elements comprising the mobile support and the base, said lever axis being oriented in the direction Z, the lever being capable of occupying a rest position and a pivoted position, a retainer capable of opposing the pivoting of the lever, thus retaining the lever in its rest position and of being deactivated to release the pivoting of the lever toward the pivoted position thereof, at least one reaction member, fixed with respect to the other of the elements comprising the mobile support and the base, and capable of cooperating by contact with at least one reaction zone of the blocking arm which is distant from the lever axis, by defining a reaction surface which is inclined with respect to the direction X and with respect to the direction Z.

16. The press-brake as claimed in claim 15, wherein the base is carried by the main carriage via a rail system allowing sliding of the base with respect to the main carriage in the direction Z.

* * * * *